US005949337A

United States Patent [19]

Campman

[11] Patent Number: 5,949,337

[45] Date of Patent: Sep. 7, 1999

[54] DUAL CONTROLLED PERSONAL ALERT SAFETY SYSTEM

[76] Inventor: James P. Campman, 329 Bendhill Rd., Fredonia, Pa. 16124

[21] Appl. No.: 08/714,610

[22] Filed: Sep. 16, 1996

[51] Int. Cl.[6] ..... G08B 23/00

[52] U.S. Cl. ..... 340/573; 128/202.22; 128/204.23; 128/205.22; 128/205.23

[58] Field of Search ..... 340/573, 571, 340/574, 692, 404.3; 128/205.23, 205.22, 204.23, 202.22; 116/70

[56] References Cited

U.S. PATENT DOCUMENTS

| | | | |
|---|---|---|---|
| 3,906,934 | 9/1975 | Haverland | 128/202.22 |
| 4,860,764 | 8/1989 | Hudimac, Jr. | 128/204.23 |
| 5,097,826 | 3/1992 | Gray et al. | 128/202.22 |
| 5,365,923 | 11/1994 | Lundberg | 128/205.23 |
| 5,492,110 | 2/1996 | Lenz et al. | 128/205.22 |
| 5,506,571 | 4/1996 | Dugan | 128/204.23 |
| 5,541,579 | 7/1996 | Kiernan | 340/573 |
| 5,640,148 | 6/1997 | Lewis et al. | 340/573 |

*Primary Examiner*—Jeffery A. Hofsass
*Assistant Examiner*—John Tweel, Jr.
*Attorney, Agent, or Firm*—Daniel K. Dorsey

[57] ABSTRACT

The present invention pertains to a small, lightweight personal alert safety system which has a self-contained battery powered electrical and electronic circuit which is automatically activated when the breathing air SCBA is charged (pressurized) among other components, in a small casing for use by personnel working in dangerous environments, e.g., firefighters and rescue workers and the like. In the preferred embodiment, a pneumatic system is controlled by the air supply. The system cannot be turned off when the air supply is on. This safety feature insures that the firefighter is protected.

3 Claims, 2 Drawing Sheets

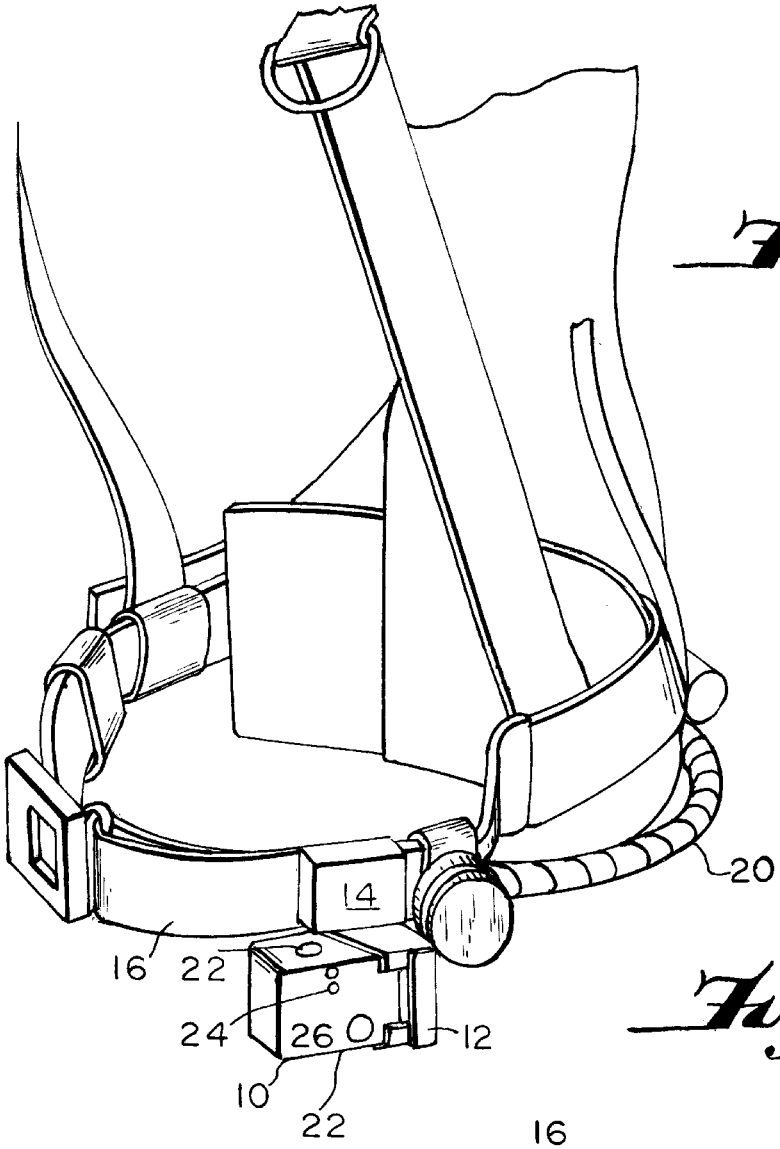
Fig. 2.
Fig. 1.
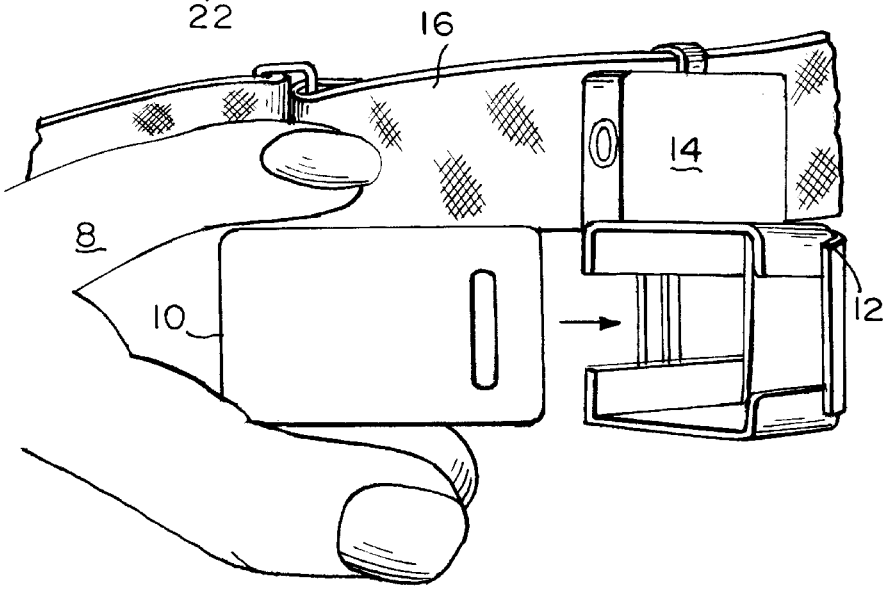

DUAL CONTROLLED PERSONAL ALERT SAFETY SYSTEM

My companion design application Ser. No. 29/054,545, filed on May 16, 1996, entitled HARNESS FOR PERSONAL SECURITY ALARM and discloses an external harness configuration for the present invention. Additionally, my U.S. Pat. No. 5,317,305 patented May 31, 1994, entitled PERSONAL ALARM DEVICE WITH VIBRATING ACCELEROMETER MOTION DETECTOR AND PLANAR PIEZOELECTRIC HI-LEVEL SOUND GENERATOR discloses an alarm device and lights which are hereinafter incorporated by reference thereto.

BACKGROUND OF THE INVENTION

1. Field of the Invention:

The present invention pertains to a small, lightweight personal alert safety system which has a self-contained battery powered electrical and electronic circuit. This system automatically activates when the SCBA (Self Contained Breathing Apparatus) breathing air supply is turned on. This system and components thereof are housed in a small casing for use by personnel working in dangerous environments, e.g., firefighters and rescue workers and the like.

The purpose of a personal alert safety system is to sound a loud audio alarm if a distressful situation should occur. A personal alert safety system can be activated either manually or automatically. When using a personal alert safety system in the automatic or manual mode of operation, the alarm will sense the absence of motion if the wearer should become immobilized for a predetermined time period. The alarm will then sound a loud, easily recognized audio alarm that will not turn itself off unless it is manually reset. This sound serves as an audio beacon that aids others in finding the downed person (fireman). Personal alert safety systems may also be manually activated to summon help. The devices are normally attached to a SCBA harness, a turnout coat or other protective clothing. A personal alert safety system can be a lifesaving device when used properly by personnel involved in hazardous occupations such as fire fighting.

2. Description of Related Art.

In the U.S. Pat. No. 5,317,305, I patented a lighter, smaller and more reliable personal alert safety system than prior art alarm systems. The system of this patent features electronic switching for enhanced reliability. It incorporated novel embodiments of vibrating accelerometer for motion detectors and a novel planar, low profile sealed, piezo hi-level sound generating transducer structurally and functionally coordinated with resonating chamber casing structure to provide a hi-level audio alarm. The lack of motion alarm sounds a loud, easily recognized, sweeping audio type of signal if the wearer should become motionless. If the wearer is exposed to excess temperature, the system will sound a different kind of easily recognized, pulsed audio alarm. The alarm sound for lack of motion is thus distinctly different from the alarm sound for excessive temperature.

U.S. Pat. No. 5,254,970 to Brady is a personal device that included programmable alarm means. This device permits the user to activate and deactivate the alarm by selectively entering a code.

U.S. Pat. No. 4,418,337 to Bader is a motion detector for monitoring the movement of the individual wearing the device. If the wearer is injured and immobilized, the device provides an alarm signal to summon aid for the individual.

U.S. Pat. No. 4,247,844 to Zapolski addresses an alarm, a lamp and an actuator for elderly people. The alarm is powered by pressurized gas which emits a shrieking sound.

U.S. Pat. No. 4,090,185 to Patty is a self-contained signaling device in a detachable housing which has both a strobe light or high intensity and a loud horn. The device can be mounted on the helmet or, alternatively to another part of the body.

While these various inventions in the prior art have provided improvements in personal alert safety systems, none provide a personal alert safety system which when inserted into it's holding harness or receptacle, automatically comes under the control of the SCBA.

SUMMARY OF THE INVENTION

Throughout the world, firefighters depend on their personal alert safety system alarms to call for help in an emergency. These alarms will automatically sound a loud audible sound (call for help sound) if the firefighter should become immobilized. The alarm can also be manually activated.

Present day personal alert safety system alarms are required as part of a firefighter's safety apparatus and are manually activated. Because of the urgency and excitement at the fire scene, firefighters sometimes forget to turn their personal alert safety system devices on, thus negating any protection that the personal alert safety system alarm may provide.

The present invention solves this problem. The duo-personal alert safety system (dual controlled personal alert safety system alarm) addresses the problem of non-activation of the safety system. When the duo-personal alert safety system of the present invention is inserted into it's receptacle, the duo-personal alert safety system automatically comes under the control of the SCBA breathing air tank. As long as the SCBA is pressurized, the duo-personal alert safety system is activated and can not be turned "off".

Accordingly, it is an object of the present invention to describe a duo-personal alert safety system, in a small, lightweight, high impact casing.

It is another object of the present invention to describe a means for providing activation of the system when the SCBA is pressurized.

A further object of the present invention is to describe the operations of a spring and a magnet wherein the spring pushes the magnet into a first position and recoils the magnet into a second position.

It is an object of the present invention to describe an on/off switch for activating the system and programmable microprocessor connected to the on/off switch for controlling the system when activated.

Another object of the present invention is to include visual safety components positioned on the small lightweight, high impact casing and connected to the microprocessor.

Additionally, an object of the invention is to describe magnetic activated switch means connected to the microprocessor and the power means. The switch activates relative to the position of the magnet and operates in a closed position when the magnet is in the first position and an open position when the magnet is in the second position.

It is an object of the present invention to describe the visual safety components as being as least two lights and operating in at least two distinctly different patterns when lit, wherein the first pattern is a wig-wag pattern, and the second pattern is a pulsed strobe flash. Additionally, the visual safety components are described as at least two lights and operating in at least two distinctly different colors when lit, where the first color is yellow, and the second color is red.

Further novel features and other objects of this invention will become apparent from the following detailed description, discussion and the appended claims taken in conjunction with the accompanying drawings.

BRIEF DESCRIPTION OF DRAWINGS

A preferred structural system embodiment and preferred subcomponents of this invention are disclosed in the accompanying drawings in which:

FIG. 1 is a perspective view of the personal alert safety system of the present invention being placed in the receptacle or harness.

FIG. 2 is a perspective view of the personal alert safety system of the present invention in the receptacle or harness of the firefighter's belt and connected to the air hose.

DESCRIPTION OF THE PREFERRED EMBODIMENT

Figure 3:
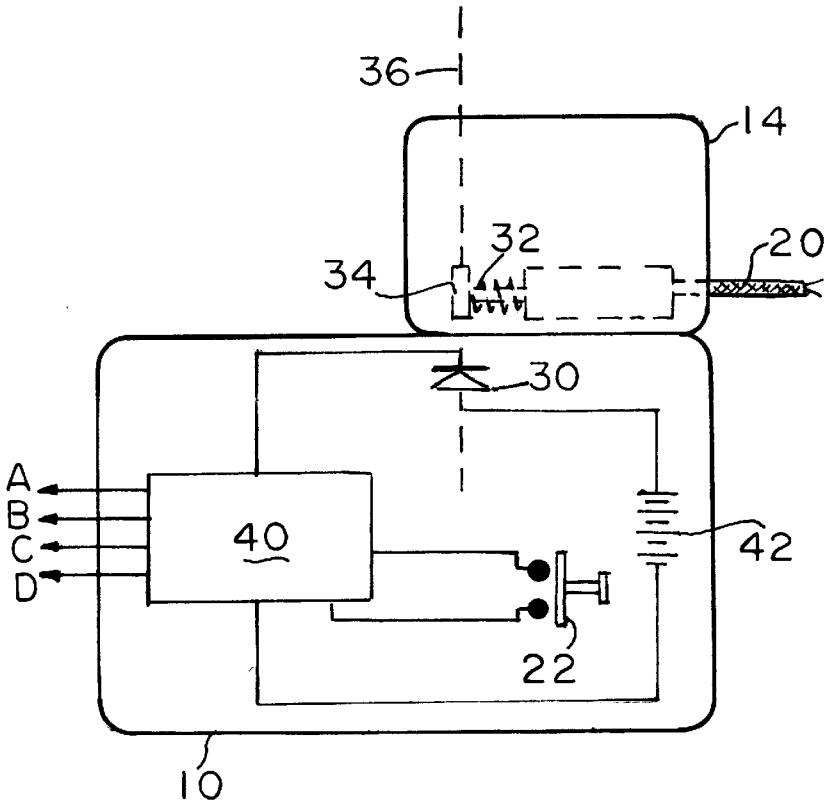
FIG. 3 illustrates an enlarged diagrammatic view of the personal alert safety system of the present invention when the air line is "on" (pressurized) and the contact is closed.

With respect to the figures and with specific reference to FIG. 1, the following describes a personal alert safety system that may be used as a manually activated personal alert safety system alarm in accordance with NFPA/OSHA regulations, or as an automatically activated personal alert safety system when the firefighter turns his air breathing supply on. FIG. 1 illustrates a hand 8 of a firefighter simply inserting the duo-personal alert safety system 10 into it's mating receptacle holder 12. The mating receptacle holder is shown securely attached to a casing or solenoid housing 14. The solenoid housing 14 is securely attached to the firefighter's belt 16. Of course, it is contemplated that the duo-personal alert safety system 10 can be fixed, attached or connected to nearly any secure part of the personnel. However, the preferred embodiment utilizes pneumatic means and, thus, is shown connected to the belt 16.

Referring to FIG. 2, when inserted in the holder 12, the duo-personal alert safety system 10 is controlled through the solenoid housing 14 which is controlled by the firefighter's air supply by way of an air hose 20. Of course, in this preferred embodiment, the air hose 20 is connected to the air supply which is not shown. Accordingly, when the air supply is turned on (pressurized), the duo-personal alert safety system 10 is activated. Since the duo-personal alert safety system 10 is now controlled by the pressurized air hose 20 and it's air supply, the system 10 cannot be manually turned off. This safety feature insures that the firefighter will always have protection offered by the duo-personal alert safety system 10 as soon as his air supply is turned on. In other words, if the firefighter forgets to manually switch on the duo-personal alert safety system 10 by way of the on/off buttons, 22, as soon as the air supply is pressurized, the duo-personal alert safety system 10 switches on and cannot be switched off until the air system is turned off or depleted.

FIG. 2 additionally illustrates two plastic lens 24, secured by adhesive into two apertures in the front face 26 of the duo-personal alert safety system 10. The lens 24 are in line with two LEDs secured on the interior of the system 10 and when activated will flash in a wig-wag high intensity visual signal or in a strobe like fashion. The operation of these LEDs will be described in more detail with the operation of the system 10.

Figure 4:
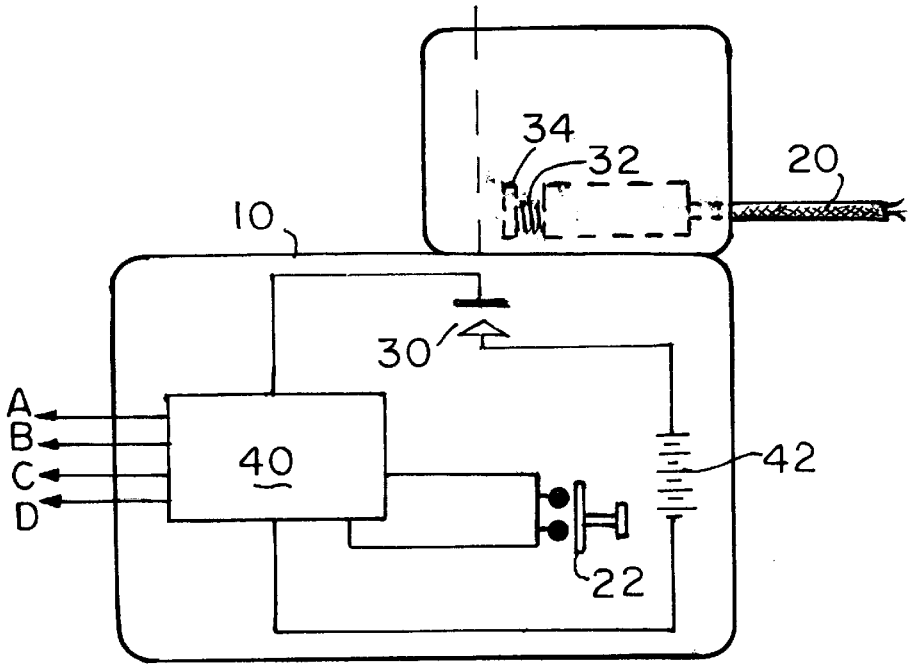
FIG. 4 illustrates an enlarged diagrammatic view of the personal alert safety system of the present invention when the air line is "off" (depressurized) and the contact is open.

With respect to the principles of operation for the duo-personal alert safety system 10, reference is now made to FIG. 3 which shows an enlarged diagrammatic view of the duo-personal alert safety system 10 of the present invention when the air line is pressurized and the contact 30, connected to the solenoid housing 14, is closed. FIG. 4, also, shows the enlarged diagrammatic view of the duo-personal alert safety system 10 of the present invention when the air line is depressurized and the contact 30 is open.

The magnetically sensitive sensor or contact 30 is contained within the duo-personal alert safety system 10. If a magnetic field is not present the system 10 operates as a stand-alone NFPA compliant personal alert safety system device. If a magnetic field is present, the duo-personal alert safety system 10 senses through the magnetically sensitive sensor 30 the presence of the magnetic field. The presence of a magnetic field is caused by the air supply entering the air hose 20. Since the air hose 20 is connected to the air activated solenoid, the pneumatic pressure causes a spring 32 to push a magnet 34 to a first position 36. In this first position 36, which is indicated by the dash lines, the magnet 34 produces a detectable magnetic field. The magnetic field is detected or sensed by the magnetic activated contact 30 which closes.

In other words, this is a pressure sensing mechanism which causes the magnetic field to change resulting in the switch or contact 30 to close. In this state, the system 10 cannot be turned "OFF". A microprocessor 40 is powered up (made active) when the magnetically activated contact 30 closes. As described, this action occurs when the magnet 34, which is attached to the air activated solenoid 14, is in alignment with the switch contact 30 as depicted by the dashed line 36. Upon power up condition, the microprocessor 40 will go into a latched "ON" mode of operation and cannot be turned off via the reset button (off button) as long as the magnetic switch 30 is closed. When the switch 30 closes, the microprocessor 40 alters its program such that the system cannot be turned off.

The lights 24 operate as visual signals. The lights 24 are connected to the microprocessor 40 by way of connections A, B, C, and D. The lights will change state when the duo-personal alert safety system 10 is turned "on" and again when the duo-personal alert safety system 10 goes into alarm. The visual signals produced during the first operation are two yellow lights which will flash in a wig-wag fashion similar to the warning lights one sees at a railroad crossing. If the duo-personal alert safety system 10 goes into the alarm mode, these lights will change color from yellow to red and the wig-wag display will change to a pulsed strobe like flash (both lights are on or both lights are off). These visual features help to identify a downed firefighter and is an aid in determining if the firefighter's duo-personal alert safety system 10 is in the alarm state in a high noise environment.

FIG. 4 illustrates the magnet 34 in a second position. In this position, the air from the air hose 20 is turned "OFF" (depressurized). Since there is no magnetic field produced such that the magnetic switch 34 can detect or sense, the magnetic switch or contact 34 is open. At this point, the duo-personal alert safety system 10 is in manual control. The firefighter can control the duo-personal alert safety system 10 with the on/off switches 22. The system 10 is powered by a battery element 42.

The duo-personal alert safety system 10 can be configured such that if it is removed from its holster housing the unit will go into alarm. Thus insuring that the duo-personal alert safety system 10 is always properly inserted into its housing 12.

The foregoing is considered as illustrative only of the principles of the invention. Further, since numerous modifications and changes will readily occur to those skilled in the art, it is not desired to limit the invention to the exact construction and operation shown and described. For example, the concept of changing the electronic function of the duo-personal alert safety system 10 by the internal sensor sensing the presence of a magnetic field may be achieved by other means such as a digitally encoded radio signal that is transmitted when the air supply is turned on. This signal is detected by an internal radio receiver that activates a switch closure. Also, a digitally encoded infrared communication link has been contemplated as have other electrometric signals such as pulsed x-rays, gamma rays and other spectrum means. Accordingly, all suitable modifications and equivalents may be resulted to, so as to fall within the scope of the invention which is intended to be limited only by the scope of the appended claims.

What is claimed and desired to be secured by Letters Patent is:

1. A personal alert safety system comprising:

a first part, said first part having air activated solenoid means, said air activated solenoid means connecting to a breathing apparatus, and having a spring and magnet wherein said spring pushing said magnet into a first position and recoiling said magnet into a second position;

a second part in a small, lightweight, high impact casing, said second part having activation means for activating said system when said magnet is in said first position;

an on/off switch, positioned in said second part, for switching on and off said system;

microprocessor means positioned in said second part and connected to said on/off switch for controlling said system when activated in said first position;

power means, positioned in said second part and connected to said microprocessor, for providing power to said second part when said magnet is in said first position;

visual safety components, said visual safety components being positioned on the small lightweight, high impact casing and connected to said microprocessor means; and magnetic activated switch means, positioned in said second part and connected to said microprocessor means and said power means, being activated relative to the activation of said magnet wherein said magnetic activated switch means having a closed position for operating in an automatic mode when said magnet is in said first position and an open position for operating in a manual mode when said magnet is in said second position;

wherein said microprocessor means performs as a standalone NFPA compliant personal alert safety system device in said manual mode; and wherein said microprocessor means receiving an activating signal from said magnetic activated switch means that a magnetic field has been detected wherein said microprocessor means alters said manual mode and begins said automatic mode such that the system cannot be turned off.

2. The personal alert safety system, in the small, lightweight, high impact casing as defined in claim 1, said comprising:

said visual safety components being at least two lights and operating in at least two distinctly different patterns when lit, wherein said first pattern is wig-wag pattern, and said second pattern is a pulsed strobe flash.

3. The personal alert safety system, is the small, lightweight, high impact casing, as defined in claim 1, said system comprising:

said visual safety components being at least two lights and operating in at least two distinctly different colors when lit, wherein said first color is yellow, and said second color is red.

* * * * *